US008051589B2

(12) United States Patent
Adams

(10) Patent No.: US 8,051,589 B2
(45) Date of Patent: Nov. 8, 2011

(54) CLOTHING IRON HOLDER WITH WATER RESERVOIR

(76) Inventor: Sky A. Adams, Augusta, GA (US)

( * ) Notice: Subject to any disclaimer, the term of this patent is extended or adjusted under 35 U.S.C. 154(b) by 348 days.

(21) Appl. No.: 12/448,818

(22) PCT Filed: Dec. 19, 2007

(86) PCT No.: PCT/US2007/025827

§ 371 (c)(1),
(2), (4) Date: Jul. 8, 2009

(87) PCT Pub. No.: WO2008/091332

PCT Pub. Date: Jul. 31, 2008

(65) Prior Publication Data

US 2010/0024257 A1 Feb. 4, 2010

(51) Int. Cl.
*D06F 79/02* (2006.01)
*D06F 75/14* (2006.01)

(52) U.S. Cl. ..... 38/96; 219/259

(58) Field of Classification Search ..... 38/77.3, 38/77.4, 77.6, 79, 96; 219/259
See application file for complete search history.

(56) References Cited

U.S. PATENT DOCUMENTS

| | | | | |
|---|---|---|---|---|
| 2,620,576 | A * | 12/1952 | Stevenson et al. | 38/77.3 |
| 4,565,019 | A * | 1/1986 | Cavalli | 38/77.6 |
| 5,074,066 | A | 12/1991 | Sakano et al. | |
| 5,108,056 | A | 4/1992 | McBounds | |
| 5,117,092 | A | 5/1992 | Shimizu et al. | |
| 5,315,773 | A * | 5/1994 | Iwami et al. | 38/77.6 |
| 5,414,945 | A | 5/1995 | Freeman et al. | |
| 5,909,862 | A | 6/1999 | Ratliff et al. | |
| 6,021,591 | A * | 2/2000 | Basile | 38/77.6 |
| 6,116,550 | A | 9/2000 | Forbes | |
| 6,212,332 | B1 | 4/2001 | Sham et al. | |
| 6,550,164 | B2 | 4/2003 | Rosa | |
| 6,622,404 | B2 | 9/2003 | Valiyambath | |
| 7,140,580 | B1 | 11/2006 | Hays | |

FOREIGN PATENT DOCUMENTS

| | | | |
|---|---|---|---|
| DE | 003208603 | A1 * | 12/1983 |
| DE | 003544506 | A1 * | 6/1987 |
| EP | 000315915 | A1 * | 5/1989 |
| EP | 000574602 | A1 * | 12/1993 |
| JP | 359075093 | A * | 4/1984 |
| WO | WO 01/64992 | | 9/2001 |

* cited by examiner

*Primary Examiner* — Ismael Izaguirre
(74) *Attorney, Agent, or Firm* — Richard C. Litman

(57) ABSTRACT

The clothing iron holder with water reservoir (10) is a protective accessory for use with a clothing iron (12) or the like. The holder (10) includes a water reservoir (16) and is sized and shaped to receive a clothing iron (12). The holder (10) has an opening (30) for releasably covering the iron's water fill opening (14) so that if the iron (12) is inadvertently tipped over or falls, water exiting the water fill opening (14) is received within the water reservoir (16). Further, when received within the holder (10), a lower face (42) of the clothing iron (12) is supported by an upper surface of the central portion (22), and the upper surface preferably has a heat-resistant padded layer (40) formed thereon.

20 Claims, 2 Drawing Sheets

CLOTHING IRON HOLDER WITH WATER RESERVOIR

TECHNICAL FIELD

The present invention relates to protective holders and supports for a steam-type clothing iron. Particularly, the clothing iron holder includes protective, heat-resistant padding for the clothing iron, and further includes a water reservoir for collecting water spilled from the water fill opening of the clothing iron.

BACKGROUND ART

Clothing irons are typically heavy pieces of equipment which operate at relatively high temperatures. When not ironing clothing, users typically rest the clothing iron on its rear face, such that the heated contact plate is positioned substantially orthogonal to the clothing or ironing surface. This position, however, is not particularly stable, and the iron may be easily tipped over or dropped. The weight of the iron may cause injury to the user, or may damage nearby furniture or the floor surface. Further, the iron operates at relatively high temperatures, and the user could be easily burned, or nearby furniture or carpeting, for example, could burn or catch on fire. Additionally, steam irons typically include an open water filling port adjacent the handle portion, and upon falling, the heated water contained therein will spill out.

It would be desirable to provide a holder for a clothing iron which not only allows the iron to be stably positioned and stored, but also offers protection from injury due to the iron's weight, and from the high temperature of the iron. It would be further desirable to provide a holder which also prevents water spillage during an accidental fall. It would be additionally desirable if spilled water could be collected within the holder for later re-usage.

Thus, a clothing iron holder with water reservoir solving the aforementioned problems is desired.

DISCLOSURE OF INVENTION

The disclosure is directed to a clothing iron holder with a water reservoir. The water reservoir has a front portion, a central portion and a rear portion. The front portion of the clothing iron holder has an opening formed through an upper end thereof. The opening is adapted for releasably covering and connecting to the water fill opening of a clothing iron. The front portion of the clothing iron holder is in fluid communication with the central and rear portions of the clothing iron holder.

In operation, the clothing iron is received by the clothing iron holder such that a front face of the clothing iron contacts the rear surface of the front portion of the clothing iron holder. A rear face of the clothing iron contacts the front surface of the rear portion of the clothing iron holder, and a lower face of the clothing iron is supported by the upper surface of the central portion of the clothing iron holder. An opening formed through the upper end of the front portion of the clothing iron holder releasably covers the water fill opening of the clothing iron such that water exiting the water fill opening of the clothing iron is received within the water reservoir of the clothing iron holder.

The disclosure is also directed to a clothing iron holder with a temperature measuring means and a temperature gauge. The temperature gauge is mounted to the clothing iron holder water reservoir so that the temperature measuring means communicates the temperature of the water in the water reservoir to the temperature gauge.

BRIEF DESCRIPTION OF DRAWINGS

Similar reference characters denote corresponding features consistently throughout the attached drawings.

BEST MODES FOR CARRYING OUT THE INVENTION

Figure 1:
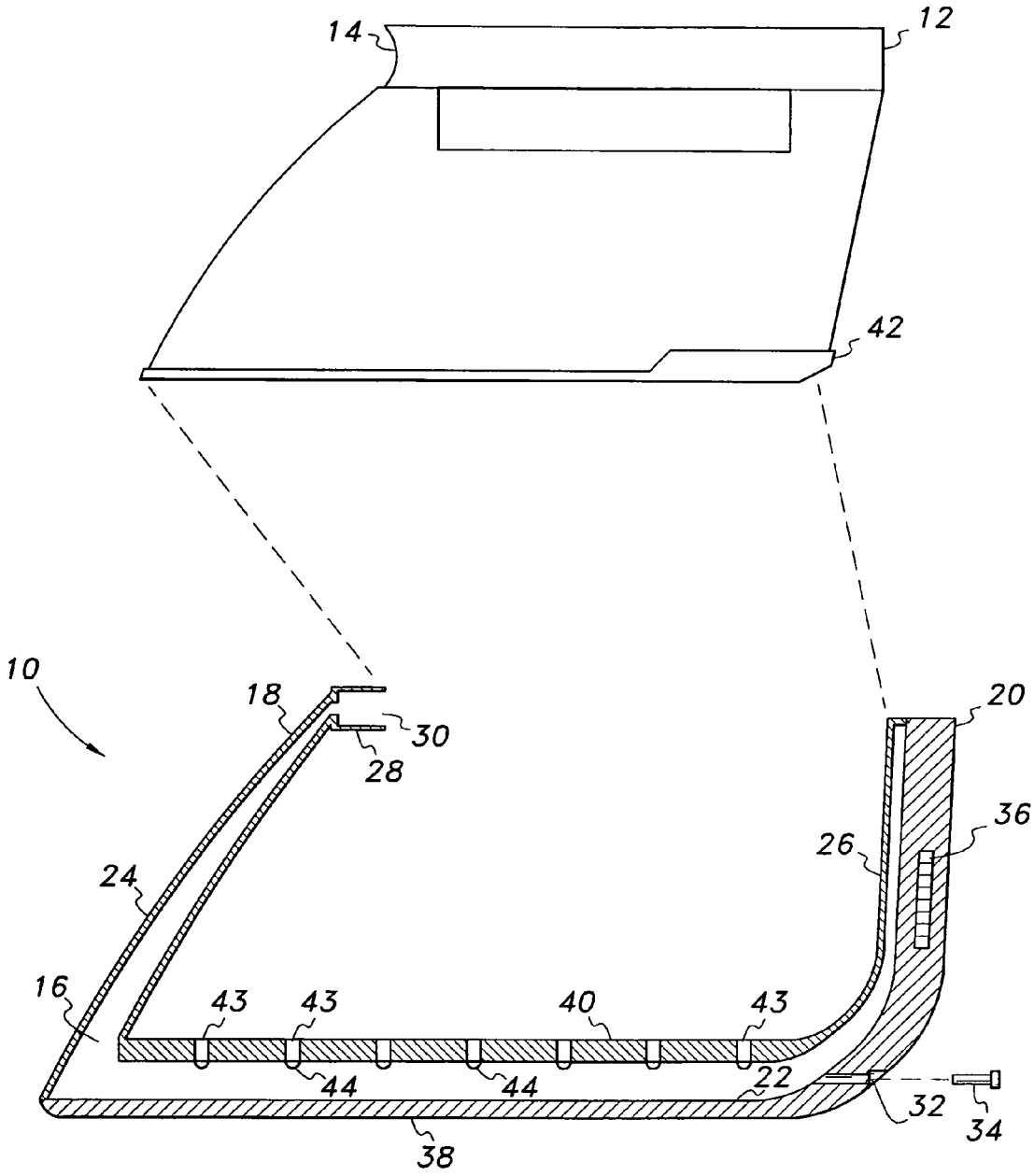
FIG. 1 is a side, cross-sectional attachment view of a clothing iron holder with water reservoir according to the present invention.

The current invention is a clothing iron holder. The holder includes a water reservoir having a front portion, a central portion and a rear portion, and is sized and shaped to receive the clothing iron. The front portion has an opening formed therethrough for releasably covering and connecting to a water fill opening of the clothing iron such that water exiting the water fill opening is received within the water reservoir. Thus, if the iron accidentally falls or is tipped over, the water will spill into, and be collected within, the water reservoir.

The front portion of the water reservoir is in fluid communication with the central portion, and the central portion is in fluid communication with the rear portion. The rear portion includes a closed upper end for retaining the water therein. Further, when received within the holder, a lower face of the clothing iron is supported by an upper surface of the central portion, and the upper surface preferably has a heat-resistant, upper padded layer formed thereon.

When held within the holder, preferably a front face of the clothing iron securely contacts a rear surface of the front portion, and a rear face of the clothing iron securely contacts a front surface of the rear portion. A clamp or other suitable means for releasable securement may be provided for retaining the clothing iron within the holder.

The heat-resistant, upper padded layer may have a plurality of conduits formed therethrough, allowing steam generated by the clothing iron to escape through the conduits and be collected within the water reservoir, where the steam will condense into liquid water. Each conduit is covered and sealed by a one-way valve seal, allowing the steam to enter the water reservoir, but preventing liquid water from escaping from the reservoir, back through the conduits.

Preferably, a heat-resistant, lower padded layer is further formed on a lower surface of the central portion and on a rear surface of the rear portion. A port may be provided for releasing collected water from the water reservoir. The port may be formed through the lower padded layer and be in fluid communication with the water reservoir. The port is selectively closeable by a cap or other suitable sealing means.

Additionally, the holder may include means for measuring temperature, such as a thermometer, temperature probe or the like, and a visual temperature indicator, such as a temperature gauge. The means for measuring temperature may measure the temperature of the lower padded layer, the temperature of the iron, the outer temperature of the water reservoir, or the temperature of the water contained within the water reservoir. The visual indicator may be a standard thermometer or the like, or may include a segmented, multi-color indicator with, for example, a blue region representing cold temperatures, and a red region representing hot temperatures.

In use, the clothing iron is received within the holder such that the front face of the clothing iron contacts the rear surface of the front portion, the lower face of the clothing iron contacts the upper padding layer, and the rear face of the clothing iron contacts the front surface of the rear portion. The clothing iron may be held within the holder by a releasable clamp or the like. An opening is formed at the upper end of the front portion, and covers the water fill opening of the clothing iron.

If the iron accidentally falls or is tipped over, the inner padded layer and the outer padded layer provide protection to the environment, and to people who may be nearby, from both the heat of the iron, and its weight. Further, water is prevented from spilling into the environment from the clothing iron by the connection of the water reservoir to the water fill opening of the clothing iron. Spilled water collects within the reservoir and may be released through the port.

Further, the water collected within the reservoir may be used at a future time to fill the clothing iron, thus conserving water. If the user wishes to fill the iron with water, the user may use the water already collected within the water reservoir or may, alternatively, fill the reservoir with water from an external source via the port.

Figure 2:
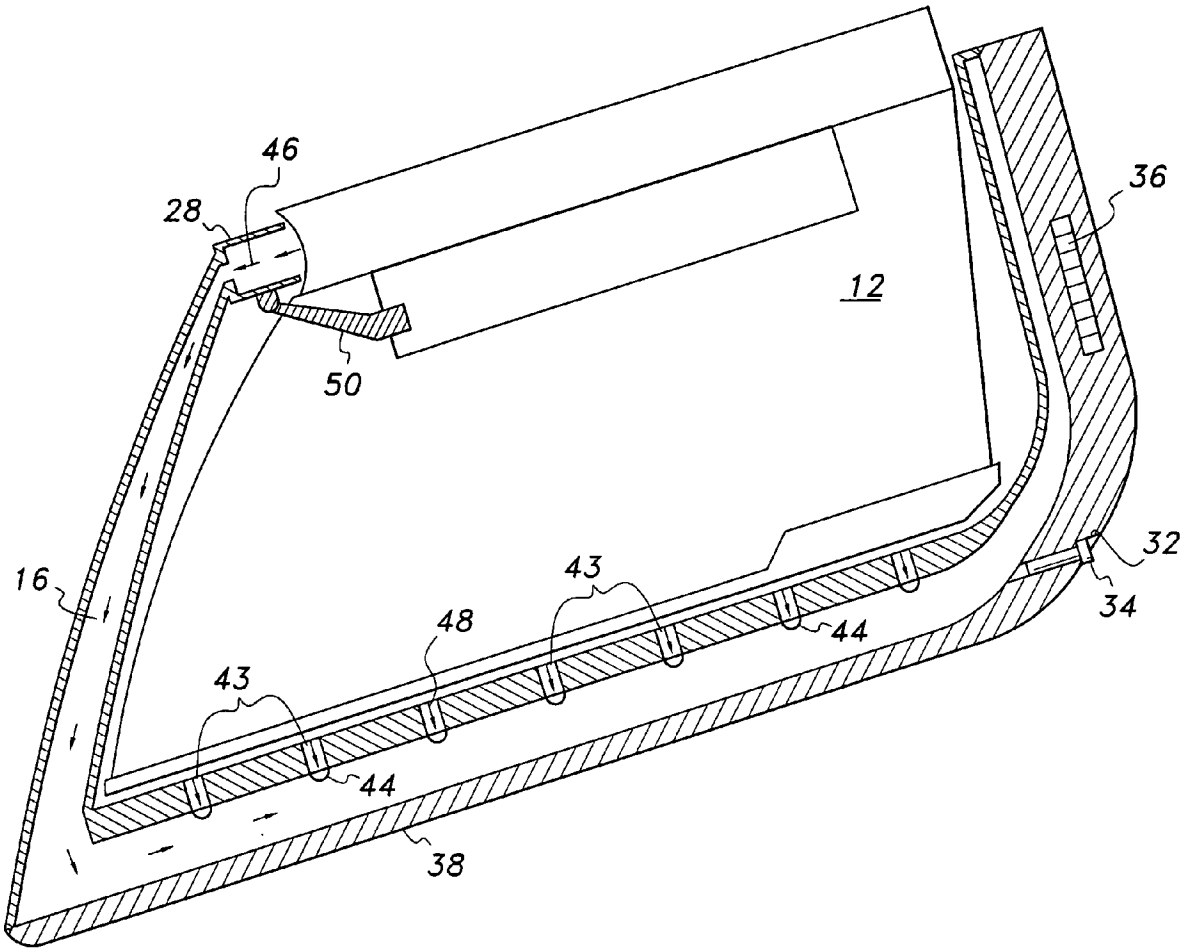
FIG. 2 is a side, cross-sectional view of the clothing iron holder with water reservoir according to the present invention, illustrating the clothing iron holder holding and retaining a clothing iron therein.

As generally shown in FIGS. 1 and 2, the clothing iron holder with water reservoir 10 is a protective accessory for use with a clothing iron, such as an exemplary steam iron 12, or the like. The holder 10 includes a water reservoir 16 having a front portion 18, a central portion 22 and a rear portion 20, and is sized and shaped to receive the clothing iron 12. The water reservoir 16 may be formed from any suitable material, dependent upon the particular needs and desires of the user. Preferably, the water reservoir 16 is formed from a resilient material, allowing for the iron 12 to be easily placed therein, and removed therefrom, while providing secure retention when the iron is positioned within the holder (as shown in FIG. 2). The water reservoir may further be formed from a relatively clear or transparent material, such as Plexiglass®, for example, thus allowing the user to visually determine the water level within reservoir 16.

The front portion 18 has an opening 30 formed therethrough for releasably covering and connecting to a water fill opening 14 of the clothing iron 12, such that water exiting the water fill opening 14 is received within the water reservoir 16 (as shown in FIG. 2). Thus, if the iron 12 accidentally falls or is tipped over, the water will spill into, and be collected within, the water reservoir 16. As shown in FIG. 1, a connector portion 28 is preferably formed at the upper end of front portion 18, with the opening 30 being formed through the connector portion 28. As best shown in FIG. 2, the connector portion 28 is contoured to provide secure and sealed engagement about the water fill opening 14 of clothing iron 12.

The front portion 18 of the water reservoir 16 is in fluid communication with the central portion 22, and the central portion 22 is in fluid communication with the rear portion 20. As shown, the rear portion 20 includes a closed upper end for retaining the water therein. Further, when received within the holder 10, a lower face (the heated contact plate) 42 of the clothing iron 12 is supported by an upper surface of the central portion 22, and the upper surface preferably has a heat-resistant, upper padded layer 40 formed thereon. The upper padded layer 40 may be formed from any suitable material which is heat-resistant and provides padded support for the iron 12, dependent upon the particular needs and desires of the user.

As shown in FIG. 1, the water reservoir 16 is defined by an outer wall 24 and an inner wall 26. When held within the holder 10, preferably a front face of the clothing iron 12 securely contacts the inner wall 26 adjacent the front portion 18, and a rear face of the clothing iron 12 securely contacts the inner wall 26 adjacent the rear portion 20. As shown in FIG. 2, a clamp 50 or other suitable means for releasable securement may be provided for retaining the clothing iron 12 within the holder 10. The clamp may be any suitable retaining means for releasably securing the iron 12 within the holder 12.

The heat-resistant, upper padded layer 40 may have a plurality of conduits 43 formed therethrough, allowing steam generated by the clothing iron 12 to escape through the conduits 43 and be collected within the water reservoir 16 (illustrated by directional arrows 48 in FIG. 2), where the steam will condense into liquid water. Each conduit 43 is covered and sealed by a one-way valve seal 44, allowing the steam to enter the water reservoir 16, but preventing liquid water from escaping from the reservoir 16, back through the conduits 43. Any suitable type of valve or seal may be utilized for preventing the backflow of water into the conduits 43, dependent upon the particular needs and desires of the user.

Preferably, a heat-resistant, lower padded layer 38, formed from rubber or any other suitable material, is further formed on the outer surface 24 adjacent the central portion 22, and may extend to cover the outer surface 24 adjacent the rear portion. Further, a port 32 may be provided for releasing collected water from the water reservoir 16. The port 32 may be formed through the lower padded layer 38 and is in fluid communication with the water reservoir 16. The port 32 is selectively closeable by a cap, plug or other suitable sealing means 34.

Additionally, the holder 10 may include means for measuring temperature, such as a thermometer, temperature probe or the like, and a visual temperature indicator, such as a temperature gauge 36. The means for measuring temperature may measure the temperature of the lower padded layer 38, the temperature of the iron 12, the outer temperature of the water reservoir 16, or the temperature of the water contained within the water reservoir 16. The choice of temperature sensing means (such as a thermometer, temperature probe, thermocouple, etc.) is dependent upon the particular needs and desires of the user, and may be mounted within the lower padded layer 38, or at any other suitable location.

The visual indicator 36 may be a standard thermometer or the like, or may include a segmented, multi-color indicator with, for example, a blue region representing cold temperatures, and a red region representing hot temperatures. Any suitable visual indicator or temperature may be utilized, dependent upon the particular needs and desires of the user.

In use, the clothing iron 12 is received within the holder 10 such that the front face of the clothing iron 12 contacts the rear surface of the front portion 18, the contact plate of the clothing iron 12 contacts the upper padded layer 40, and the rear face of the clothing iron 12 contacts the front surface of the rear portion 20. The clothing iron 12 may be held within the holder 10 by releasable clamp 50 or through any other suitable means for releasable securement. An opening 30 is formed through connector portion 28, at the upper end of the front portion 18, and covers the water fill opening 14 of the clothing iron 12.

If the iron 12 accidentally falls or is tipped over, the inner padded layer 40 and the outer padded layer 38 provide protection to the environment, and to people who may be nearby, from both the heat of the iron 12, and its weight. Further, water is prevented from spilling into the environment from the clothing iron 12 by the connection of the water reservoir 16 to the water fill opening 14 of the clothing iron 12. Spilled water collects within the reservoir 16 (shown by directional arrows 46 in FIG. 2) and may be released through the port 32.

Further, the water collected within the reservoir 16 may be used at a future time to fill the clothing iron 12, thus conserving water. If the user wishes to fill the iron 12 with water, the user may use the water already collected within the water reservoir 16 or may, alternatively, fill the reservoir 16 with water from an external source via the port 32.

It is to be understood that the present invention is not limited to the embodiments described above, but encompasses any and all embodiments within the scope of the following claims.

The invention claimed is:

1. A clothing iron holder with water reservoir, comprising:

a water reservoir having a front portion, a central portion and a rear portion, the front portion having an opening formed through an upper end thereof and having a front surface and a rear surface, the opening being adapted for releasably covering and connecting to a water fill opening of a clothing iron, the front portion being in fluid communication with the central portion, the central portion being in fluid communication with the front portion and the rear portion, and the rear portion having a closed upper end and having opposed front and rear surfaces, the central portion having an upper surface and a lower surface, whereby the clothing iron is received by the clothing iron holder such that a front face of the clothing iron contacts the rear surface of the front portion, a rear face of the clothing iron contacts the front surface of the rear portion, and a lower face of the clothing iron is supported by the upper surface of the central portion, the opening formed through the upper end of the front portion releasably covering the water fill opening of the clothing iron such that water exiting the water fill opening is received within the water reservoir.

2. The clothing iron holder with water reservoir as recited in claim 1, further comprising an upper padded layer secured to the upper surface of the central portion.

3. The clothing iron holder with water reservoir as recited in claim 2, wherein at least one conduit is formed through the upper surface of the central portion and the upper padded layer, the at least one conduit being adapted for transferring water vapor from the clothing iron to said water reservoir.

4. The clothing iron holder with water reservoir as recited in claim 3, further comprising at least one one-way valve seal covering and sealing the at least one conduit.

5. The clothing iron holder with water reservoir as recited in claim 1, further comprising:

means for measuring temperature; and, a temperature gauge in communication with said means for measuring temperature, the temperature gauge being mounted to the water reservoir for visually displaying a temperature.

6. The clothing iron holder with water reservoir as recited in claim 1, further comprising a connector portion being formed on the front portion of said water reservoir, the opening being formed through the connector portion.

7. The clothing iron holder with water reservoir as recited in claim 1, further comprising a lower padded layer formed on the lower surface of the central portion of said water reservoir.

8. The clothing iron holder with water reservoir as recited in claim 7, wherein a port is formed through an outer surface of said water reservoir, an interior of said water reservoir being in fluid communication with an external environment through the port.

9. The clothing iron holder with water reservoir as recited in claim 8, further comprising a cap for selectively and releasably covering and sealing the port.

10. The clothing iron holder with water reservoir as recited in claim 9, wherein the port is formed through the lower padded layer.

11. A clothing iron holder with water reservoir, comprising:

a water reservoir having a front portion, a central portion and a rear portion, the front portion having an opening formed therethrough for releasably covering and connecting to a water fill opening of a clothing iron;

means for measuring temperature; and, a temperature gauge in communication with said means for measuring temperature, the temperature gauge being mounted to the water reservoir, whereby the clothing iron is received by the clothing iron holder such that the opening formed through the front portion releasably covers the water fill opening of the clothing iron such that water exiting the water fill opening is received within the water reservoir, a lower face of the clothing iron being supported by an upper surface of the central portion.

12. The clothing iron holder with water reservoir as recited in claim 11, further comprising an upper padded layer secured to an upper surface of the central portion.

13. The clothing iron holder with water reservoir as recited in claim 12, wherein at least one conduit is formed through the upper surface of the central portion and the upper padded layer, the at least one conduit being adapted for transferring water vapor from the clothing iron to said water reservoir.

14. The clothing iron holder with water reservoir as recited in claim 13, further comprising at least one one-way valve seal covering and sealing the at least one conduit.

15. The clothing iron holder with water reservoir as recited in claim 11, further comprising means for selectively releasing water from said water reservoir.

16. The clothing iron holder with water reservoir as recited in claim 15, further comprising a lower padded layer formed on a lower surface of the central portion of said water reservoir.

17. The clothing iron holder with water reservoir as recited in claim 16, wherein said means for selectively releasing water from said water reservoir comprise a port formed through an outer surface of said water reservoir, an interior of said water reservoir being in fluid communication with an external environment through the port.

18. The clothing iron holder with water reservoir as recited in claim 17, further comprising a cap for selectively and releasably covering and sealing the port.

19. The clothing iron holder with water reservoir as recited in claim 18, wherein the port is formed through the lower padded layer.

20. The clothing iron holder with water reservoir as recited in claim 11, further comprising a connector portion being formed on the front portion of said water reservoir, the opening being formed through the connector portion.

* * * * *